US006863008B2

(12) United States Patent
Gonen

(10) Patent No.: US 6,863,008 B2
(45) Date of Patent: Mar. 8, 2005

(54) FLEXIBLE WING-SAIL AND WIND-PROPELLED VEHICLE INCLUDING SAME

(76) Inventor: Ilan Gonen, 23 Hohit Street, 47226 Ramat HaSharon (IL)

( * ) Notice: Subject to any disclaimer, the term of this patent is extended or adjusted under 35 U.S.C. 154(b) by 0 days.

(21) Appl. No.: 10/468,403

(22) PCT Filed: Mar. 7, 2002

(86) PCT No.: PCT/IL02/00183

§ 371 (c)(1),
(2), (4) Date: Sep. 2, 2003

(87) PCT Pub. No.: WO02/072411

PCT Pub. Date: Sep. 19, 2002

(65) Prior Publication Data

US 2004/0069197 A1 Apr. 15, 2004

Related U.S. Application Data

(60) Provisional application No. 60/274,222, filed on Mar. 9, 2001.

(51) Int. Cl.[7] ..... B63H 9/04
(52) U.S. Cl. ..... 114/102.26
(58) Field of Search ..... 114/39.21, 102.26

(56) References Cited

U.S. PATENT DOCUMENTS 4,624,203 A * 11/1986 Ferguson ..... 114/102.26
4,685,410 A * 8/1987 Fuller ..... 114/39.31

* cited by examiner

*Primary Examiner*—Steven Avila
(74) *Attorney, Agent, or Firm*—G. E. Ehrlich (1995) Ltd.

(57) ABSTRACT

A flexible wing-sail for wind-propelled vehicles includes a mast to be rotatably mounted in a vertical position on the vehicle, a plurality of flexible sail panels carried by the mast, and a spreader assembly secured to battens in the sail panels for securing them to the mast and for imparting to them an airfoil shape having a leading edge fore of the mast, and a trailing edge aft of the mast. The spreader assembly includes a fixed spreader unit secured to the sail panels at the bottom of the wing-sail and fixing it to the bottom of the mast, and a plurality of slidable spreader units secured to the sail panels at longitudinally spaced locations and slidable along the mast to permit hoisting and reefing the wing-sail. The wing-sail further includes a boom pivotally coupled to the bottom of the mast and having a sliding coupling with respect to the sail panels at the trailing edge of the wing-sail, and a brake for selectively locking the mast against rotation, such that pivoting the boom while the mast is locked, changes the curvature of the airfoil shape defined by the sail panels.

21 Claims, 12 Drawing Sheets

FLEXIBLE WING-SAIL AND WIND-PROPELLED VEHICLE INCLUDING SAME

This application claims the benefit of Provisional Application No. 60/274,222, filed Mar. 9, 2001.

FIELD AND BACKGROUND OF THE INVENTION

The present invention relates to flexible wing-sails and to wind-propelled vehicles including flexible wing-sails. The invention is especially useful in wind-propelled water vehicles, and is therefore described below with respect to such application, but it will be appreciated that the invention could also be used in other applications, such as for propelling vehicles over land or ice.

The conventional water vehicle sail functions in most wind directions like a wing of lower aerodynamic efficiency than an aircraft wing because the sail is a single sheet of fabric and also because the sail form is dictated by the vehicle structure. The conventional sail includes a fixed mast, fixed points at which the sail is anchored to the vehicle, and a single-surface structure. These features do not enable such a sail to have high aerodynamic efficiency, but rather result in its having a lower lift/drag ratio than that of an aircraft wing.

In recent years, a number of wing-sails have been proposed for use in water vehicles in order to better exploit the wind forces for propelling the vehicle. Basically, a wing-sail includes two curved surfaces defining a wing which is relatively thick and rounded at its leading edge, and tapers in thickness to its trailing edge. When the rounded, leading edge of an asymmetrical wing-sail is oriented to face the wind, the difference in air pressure between its two curved surfaces creates a lifting force which, in the case of wind-driven vehicles, is translated to a forward propulsion force. Examples of various constructions of wing-sails heretofore proposed are described in U.S. Pat. Nos. 4,685,410; 4,733,624; 4,856,449; 4,895,091; 5,406,902; 5,575,233; 5,622,131; and 6,141,809, and in U.K. Patents 2,008,514; and 2,196,310.

However, the proposed solutions to the problem generally were partial only. They included the option of a rotating mast that carries with it the usual rigging and sails as well as a rigid wing that cannot be reefed. Where a soft wing-sail was proposed permitting reefing, the wing-sail had an airfoil shape which is symmetric, wholly or partly and therefore was not sufficiently efficient. Several suggested solutions proposed an asymmetric airfoil, but the departures from symmetry are limited to a movable surface in the rear part of the wing-sail. Other solutions that were suggested are limited in flexibility, or are so complex that it is doubtful whether they could function under marine conditions. In most suggested solutions, the asymmetric variations are limited to two positions only (port/starboard), without control of the curvature of the airfoil shape of the wing-sail.

There is therefore a definite need for a flexible wing-sail construction providing increased aerodynamic efficiency, capable of being reefed and taken down, of being pointed to the wind, of enabling changes of the airfoil shape to either port or starboard in accordance with the apparent wind direction, and of enabling changes in the rate of asymmetry of the airfoil shape in accordance with the apparent wind-force. Such higher efficiency would enable the attainment of higher speeds of travel, or alternatively, a reduction in the size of the sails, rigging and keel. It would also enable sailing a vessel more closely to the wind, less heeling, and more convenience in operating wind-driven vehicles, not only water vehicles, but also land and ice vehicles.

OBJECTS AND BRIEF SUMMARY OF THE INVENTION

An object of the present invention is to provide a flexible wing-sail for a wind-propelled vehicle having a number of advantages in the above respects as will be described more particularly below.

According to one aspect of the present invention, there is provided a flexible wing-sail for wind-propelled vehicles, comprising: a mast to be rotatably mounted in a vertical position on the vehicle;

a plurality of continuous flexible sail panels carried by the mast; and a spreader assembly securing the flexible sail panels to the mast and imparting to the flexible sail panels an airfoil shape having a leading edge fore of the mast, and a trailing edge aft of the mast; the spreader assembly including a fixed spreader unit secured to the flexible sail panels defining the bottom of the flexible wing-sail and fixing it to the bottom of the mast, and a plurality of slidable spreader units secured to the flexible sail panels at longitudinally spaced locations thereof and slidable along the mast to permit hoisting and reefing the flexible wing-sail by unfolding and folding the wing-sail; each of the spreader units being configured, dimensioned and secured to the flexible sail panels such as to permit flexibility between the leading and trailing edges of the portion of the wing sail occupied by the respective spreader unit.

According to further features in the described preferred embodiment, the trailing edge of each of the first and second sail panels is slidably coupled to the boom by a slide movable within a slot in the boom and urged by a spring or by an elastic line outwardly of the boom away from the pivotal coupling of the boom to the mast.

According to another aspect of the present invention, there is provided a flexible wing-sail for wind-propelled vehicle, comprising: a mast to be rotatably mounted in a vertical position on the vehicle; a plurality of flexible sail panels carried by the mast; and a spreader assembly securing the flexible sail panels to the mast and imparting to the flexible sail panels an airfoil shape having a leading edge fore of the mast, and a trailing edge aft of the mast; the spreader assembly including a fixed spreader unit secured to the flexible sail panels defining the bottom of the flexible wing-sail and fixing it to the bottom of the mast, and a plurality of slidable spreader units secured to the flexible sail panels at longitudinally spaced locations thereof and slidable along the mast to permit hoisting and reefing the flexible wing-sail.

According to further features in the described preferred embodiment, the fixed spreader unit is secured only to the sail panels at the leading edge of the flexible wing-sail and fixes them to the bottom of the mast, and the slidable spreader units are secured only to the sail panels at the leading edge of the flexible wing-sail and slidable mount them to the mast.

According to yet another aspect of the present invention, there is provided a flexible wing-sail for wind-propelled vehicles, comprising: a mast to be rotatably mounted in a vertical position on the vehicle; a plurality of flexible sail panels carried by the mast; and a spreader assembly securing the flexible sail panels to the mast and imparting to the flexible sail panels an airfoil shape having a leading edge fore of the mast, and a trailing edge aft of the mast; the flexible sail panels being secured to the spreader assembly by battens received in pockets in the flexible sail panels;

each of said spreader units being configured, dimensioned and secured to the flexible sail panels such as to permit flexibility between the leading and trailing edges of the portion of the wing sail occupied by the respective spreader unit.

As will be described more particularly below, such a construction permits the flexible wing-sail to be hoisted, reefed, lowered, or otherwise adjusted in accordance with the apparent wind direction and wind velocity. The higher efficiency capability of such a flexible wing-sail enables the vehicle to attain higher speeds of travel, or alternatively, to reduce the size of the sails and rigging. It enables more convenient operation of a vehicle driven by wind, and also enables sailing the vehicle more closely against the wind. In addition, it enables such advantages to be attained by a flexible wing-sail of a relatively simple construction.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
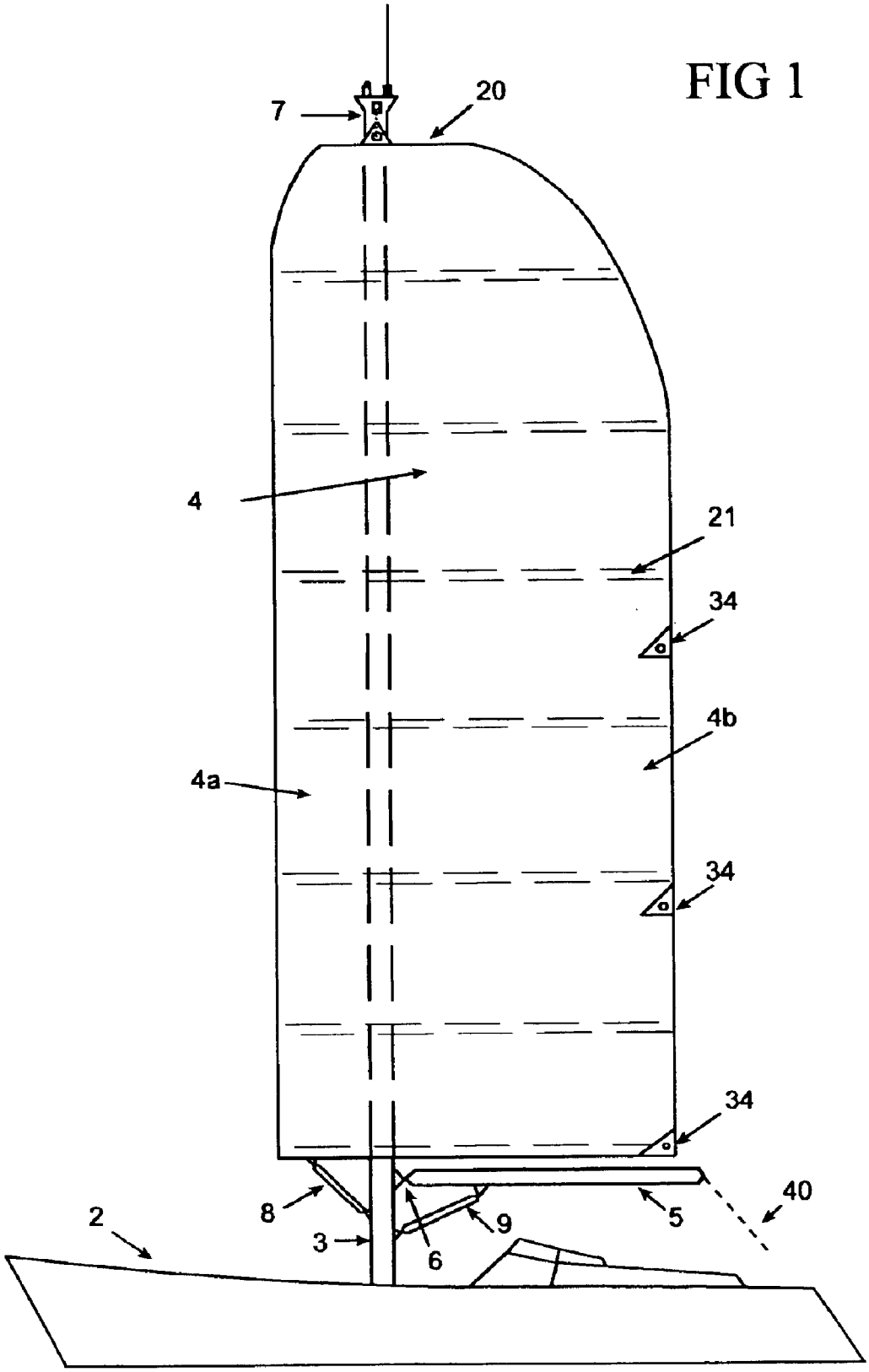
FIG. 1 illustrates one form of water vehicle equipped with a flexible wing-sail in accordance with the present invention.

FIG. 1. illustrates a water vehicle including a hull 2 having a vertically-extending mast 3 supporting a flexible wing-sail 4 constructed in accordance with the invention. The mast 3 mounts the leading edge 4*a* of the flexible wing-sail 4, whereas the trailing end of the flexible wing-sail is coupled to a boom 5 which is pivotally mounted at 6 to the mast 3. As will be described more particularly below, the flexible wing-sail 4 is made of a plurality of flexible sail panels carried by the mast 3, and includes a spreader assembly spreading the flexible sail panels and securing them to the mast. The spreader assembly imparts to the flexible sail panels an airfoil shape having leading edge 4*a* fore of the mast, and a trailing edge 4*b* aft of the mast.

The flexible wing-sail may be hoisted or lowered by a pair of halyards 7 coupled to the upper end of the flexible wing-sail. The bottom end of the flexible wing-sail 4 is attached to the bottom part of the spreader assembly, which in turn is rigidly attached to the mast 3. A bottom spar 8 braces the leading edge of the flexible wing-sail 4, and another bottom spar 9 braces the boom 5.

Figure 2:
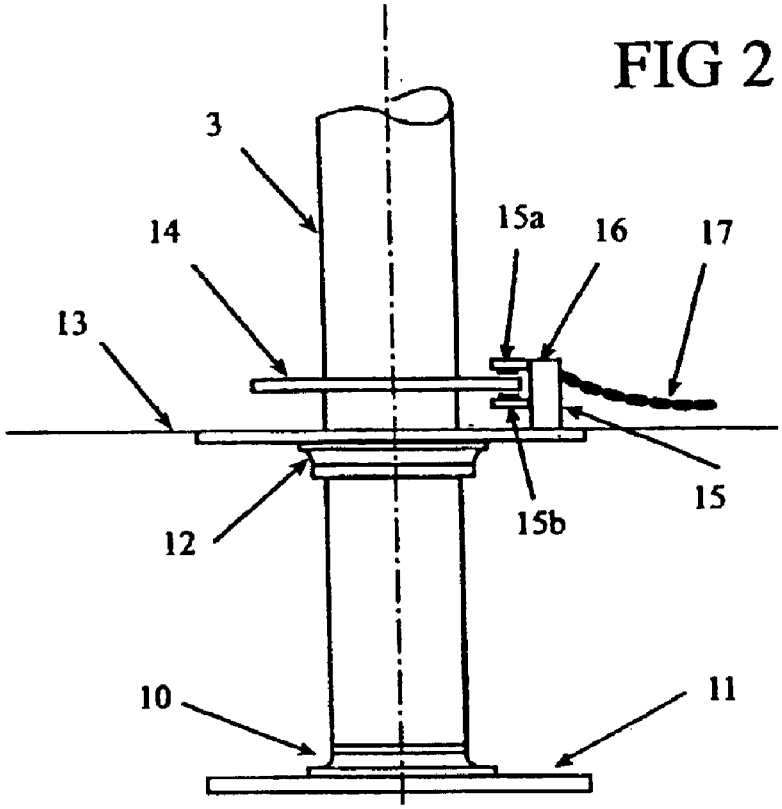
FIG. 2 is a fragmentary view illustrating the rotary mounting of the mast in the vehicle of FIG. 1.

The mast 3 is rotatably mounted to the hull 2. Thus, as shown in FIG. 2, the mast 3 is rotatably mounted between a rotary bearing 10 carried by the bottom 11 of the hull 2, and by a second rotary bearing 12 carried by the deck 13 of the hull.

As distinguished from conventional constructions, in this case the rotary mast 3 may be selectively locked against rotation by means of a brake or other locking device. FIG. 2 illustrates one example of such a locking device including a disc 14 secured to the mast 3 and having an outer edge received within the locking device 15 secured to the vehicle deck 13. The locking device 15 shown in FIG. 2 includes a pair of pressure plates 15*a,* 15*b* selectively actuated by an actuator 16 to firmly engage the disc 14 in order to lock the mast 3 against rotation, or to disengage the disc in order to permit the mast to freely rotate. Actuator 16 may be hydraulically or pneumatically actuated via a control line 17. It will be appreciated that other types of locking devices may be used.

Figure 3B:
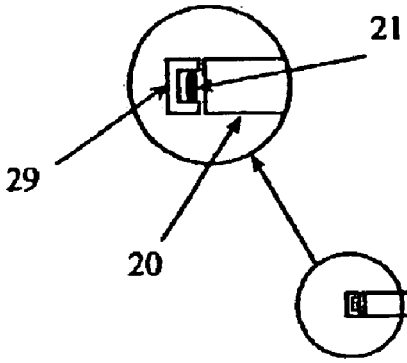
FIG. 3*b* is an enlarged fragmentary view of a portion of FIG. 3*a;*
Figure 3A:
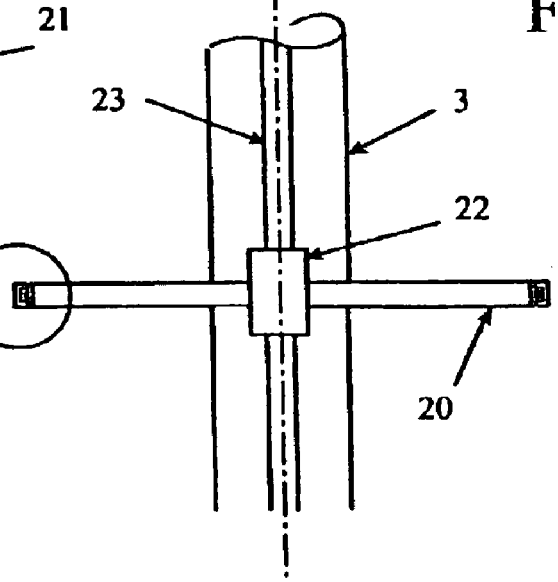
FIG. 3*a* is a fragmentary view illustrating the slidable mounting of the spreader units to the mast in the vehicle of FIG. 1.

The flexible wing-sail 4 carried by the mast 3 is constructed of a plurality of flexible sail panels, as will be described more particularly below with respect to FIGS. 4 and 5. The sail panels at their leading ends are spread apart by a spreader assembly including a plurality of vertically-spaced spreader units, one of which is shown at 20 in FIGS. 3 and 4. As shown particularly in FIG. 4, battens 21, received in pockets in the flexible wing-sail 4, are secured to the outer ends of each spreader unit 20. Each spreader unit 20 further includes a slide 22 slidable along rails 23 fixed to the opposite sides of the mast 3.

It will thus be seen that, by appropriately manipulating the halyard 7 (FIG. 1), the slidable couplings between the spreader units 20 and the rails 23 of the mast 3, permit the flexible wing-sail 4 to be deployed to a fully hoisted position, as shown in FIG. 1, to a fully reefed position, or to any partially reefed position in between.

FIGS. 4–7 illustrate the construction of the flexible wing-sail 4. It is made of flexible sail panels each of sailcloth formed with pockets for receiving the battens 21 which support and shape the flexible wing-sail.

Figure 5:
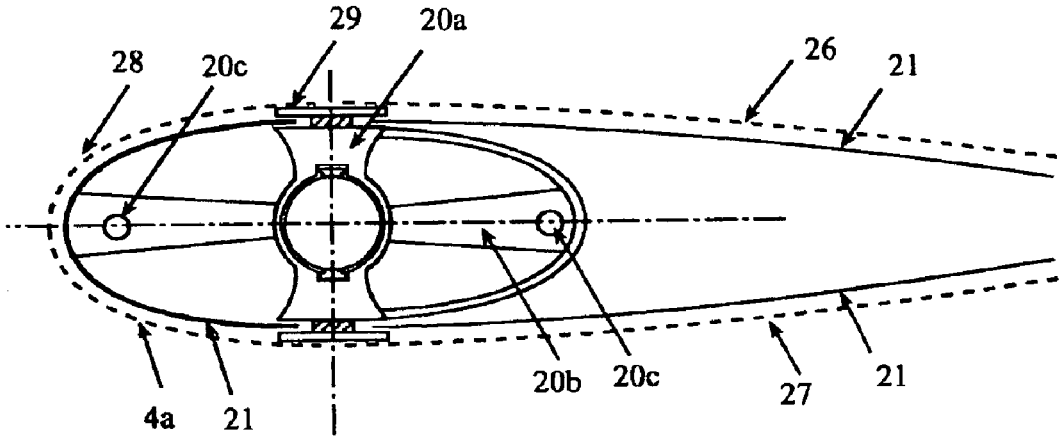
FIG. 5 is a top view illustrating the top spreader unit in the flexible wing-sail of FIG. 1.

Thus, as shown in FIG. 5, flexible wing-sail 4 is constructed of three flexible sail panels, shown in broken lines at 26, 27 and 28 each formed with the pockets for the battens 21. Flexible panel 26 extends on one side to the trailing edge 4*b* of the flexible wing-sail 4; flexible panel 27 extends on the opposite side to the trailing edge of the flexible wing-sail; and flexible panel 28 joins the leading ends of the two flexible panels 26, 27 to define the leading edge 4*a* of the flexible wing-sail 4.

Flexible panels 26, 27, 28 may be constituted of a single sheet. Alternatively, they may be made of three separate panels sewn together at their respective edges and attached to the spreader units 20 by attaching their battens 21 to the ends of the spreader units.

Preferably, the battens 21 in sail panel 28 defining the leading edge 4*a* of the flexible wing-sail 4 are stiffer than the battens 21 in the two sail panels 26, 27 defining the sides of the flexible wing-sail. As will be described more particularly below, the rounded configuration of the leading edge 4*a* of the flexible wing-sail remains substantially the same under all wind conditions, whereas the sail panels defining the two sides of the flexible wing-sail to the trailing edge 4*b* of the flexible wing-sail do change in curvature according to the apparent wind conditions. For example, the battens 21 within the leading edge sail panel 28 may be steel or plastic rods, whereas the battens in the sail panels 26 and 27 may be fiber strands.

Figure 11A:
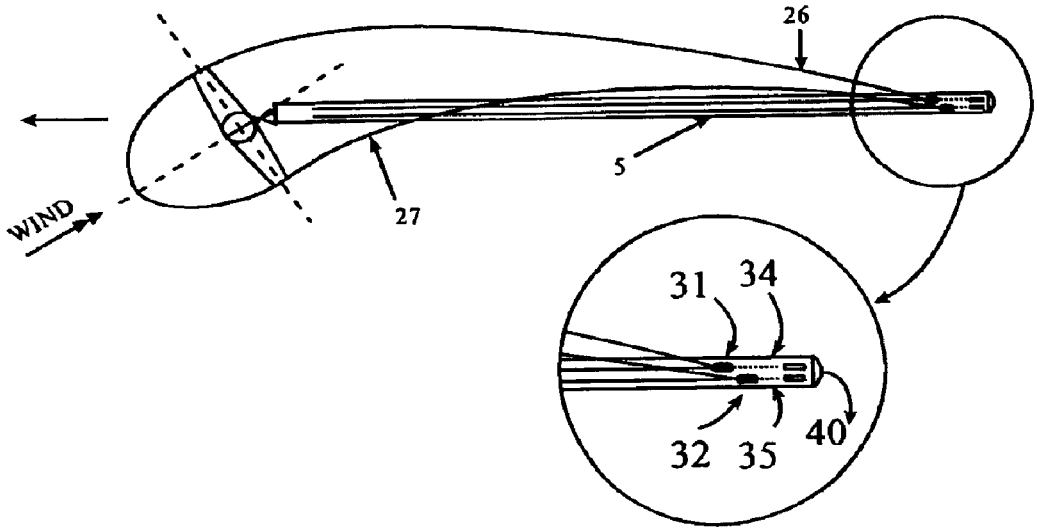
FIGS. 11*a* and 11*b* illustrate the manner in which asymmetrical curvatures to either port or starboard may be applied to the flexible wing-sail of FIG. 1.
Figure 11B:
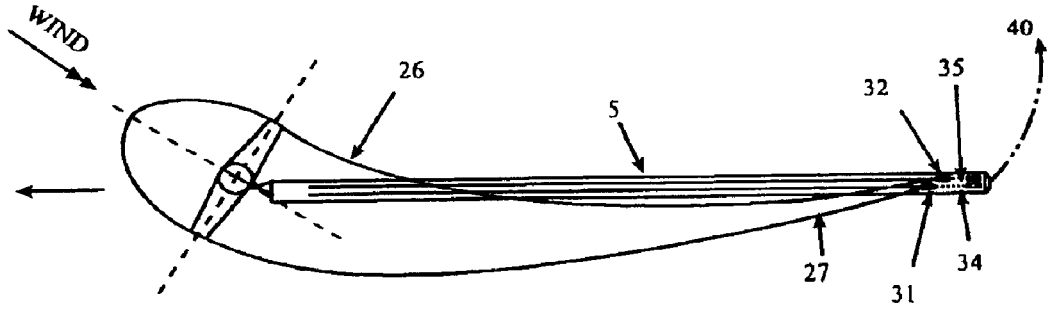

FIG. 5 illustrates one option wherein the top spreader unit 20 at the upper end of the flexible wing-sail 4 includes a transversely-extending section 20*a* which, together with an axially-extending section 20*b*, produces a thick, rounded, leading edge 4*a* to the flexible wing-sail. The effective thickness of the airfoil decreases from the transverse spreader unit 20 towards the trailing edge 4*b* of the airfoil as shown particularly in FIGS. 11*a* and 11*b*. As also shown in FIGS. 11*a* and 11*b*, the bottom of the trailing edge of sail panel 26 terminates in a slide 31 received within a slot 31*a* in the boom 5; and the bottom of the trailing edge of sail panel 27 terminates in a slide 32 received within a slot 32*a* in the boom. Slide 31 of sail panel 26 is urged outwardly of the boom 5, that is, away from its pivotal mounting 6 to the mast, by an elastic line or a spring member 34; and similarly, slide 32 of sail panel 27 is urged outwardly of the boom by an elastic line or a spring member 35. As will be described below particularly with respect to the description of FIGS. 11*a*, 11*b* and FIGS. 12*a*–12*c*, such a construction permits the asymmetric shape of the airfoil to be changed, as desired, according to apparent wind conditions.

Figure 6:
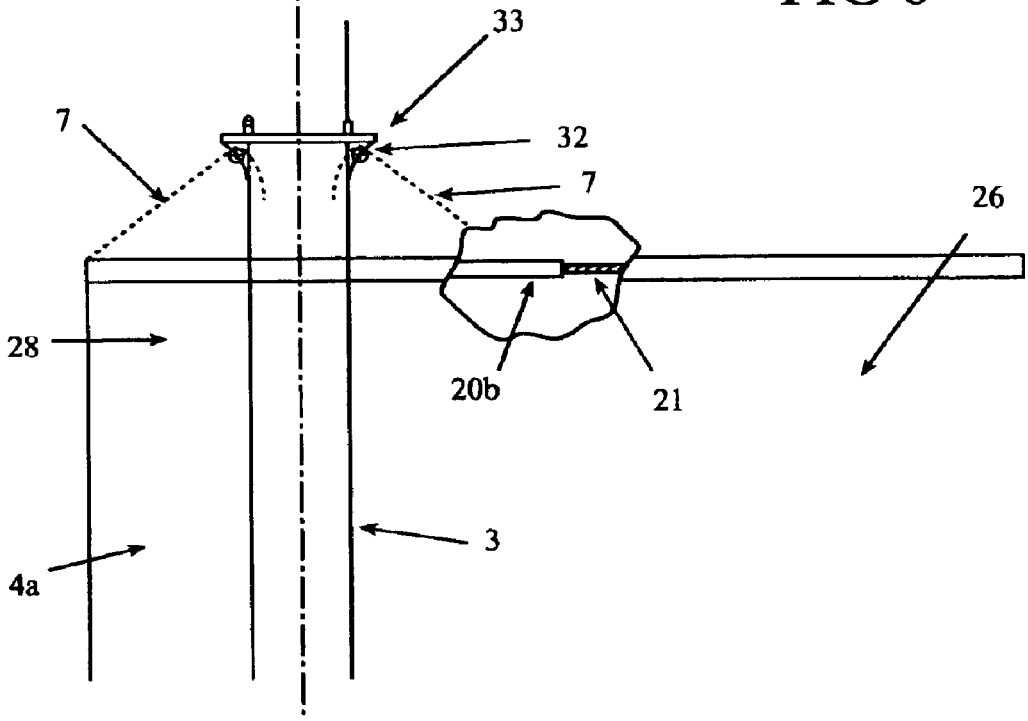
FIG. 6 is a fragmentary view of the upper end of the flexible wing-sail in FIG. 1.
Figure 7:
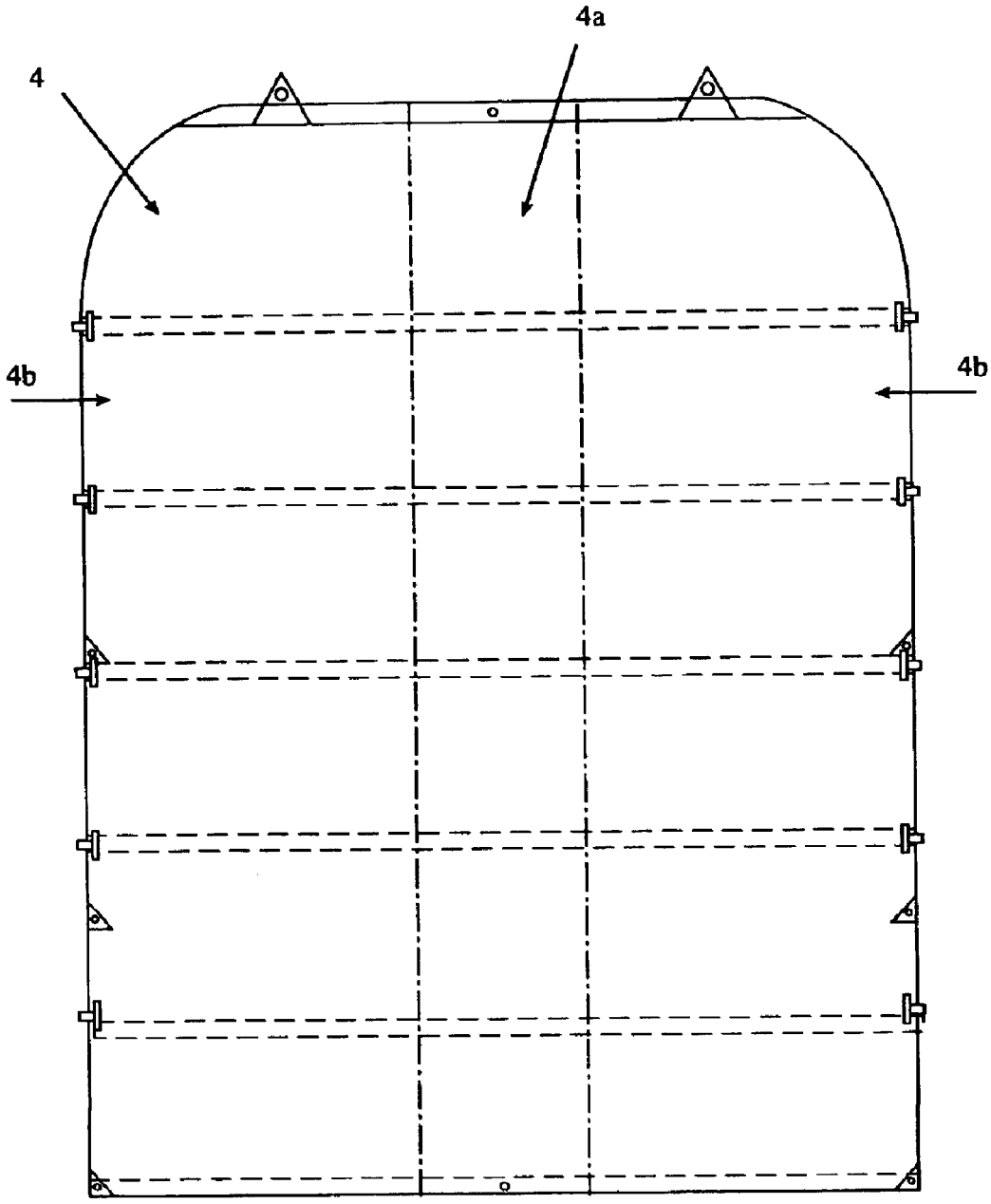
FIG. 7 is a side elevational view of the flexible wing-sail in FIG. 1.

FIG. 6 illustrates the manner of hoisting and reefing the flexible wing-sail illustrated in FIG. 5. Thus, one end of the halyards 7 would be secured at points 20*c* to the opposite ends of the axial section 20*b* of the topmost spreader unit 20. The opposite ends of the halyards 7 are then passed around rollers 42 carried by a top plate 33 at the upper end of the mast 3. The latter ends are grasped by the user such that pulling the halyards hoists the flexible wing-sail, whereas releasing the halyards permits the flexible wing-sail to be reefed by gravity.

Figure 4:
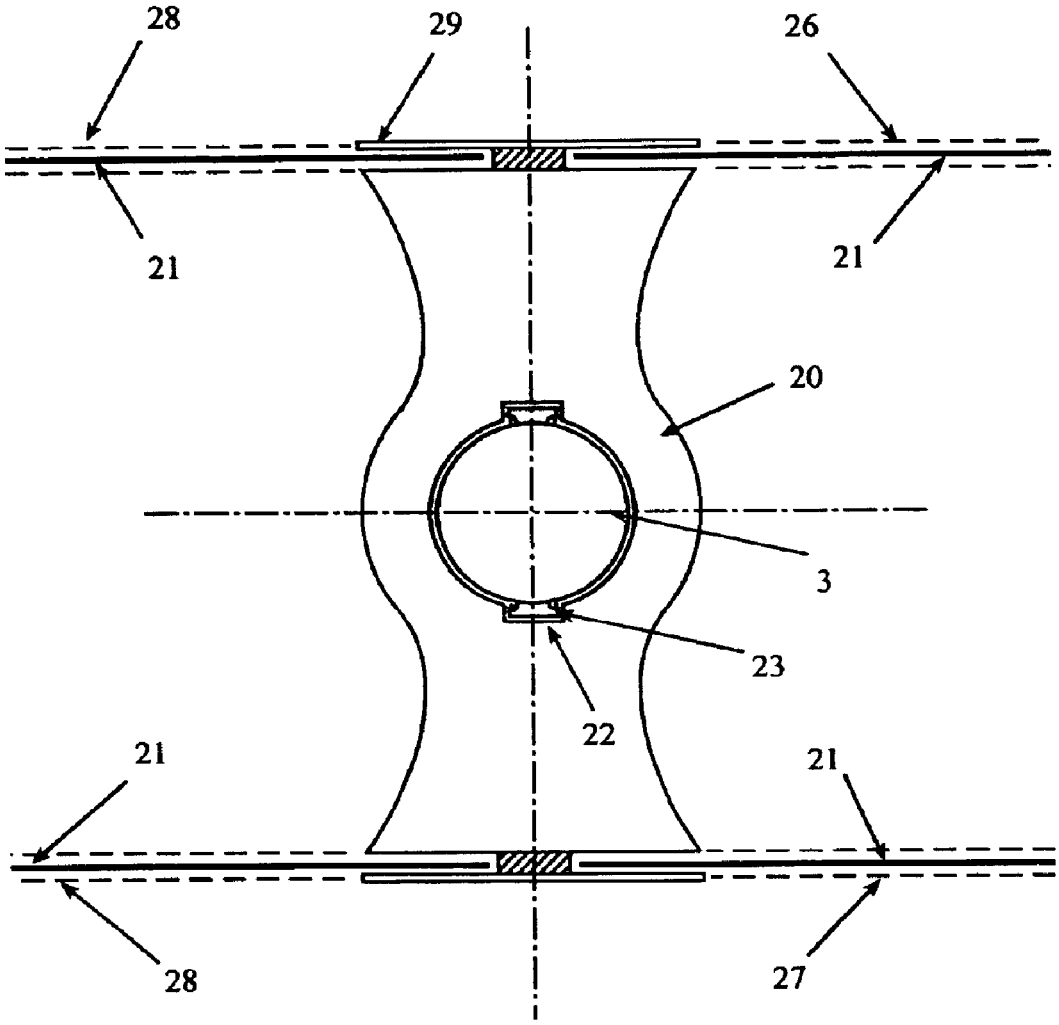
FIG. 4 is a horizontal sectional view of the flexible wing-sail in the vehicle of FIG. 1 to illustrate the structure of the slidable spreader units.
Figure 8:
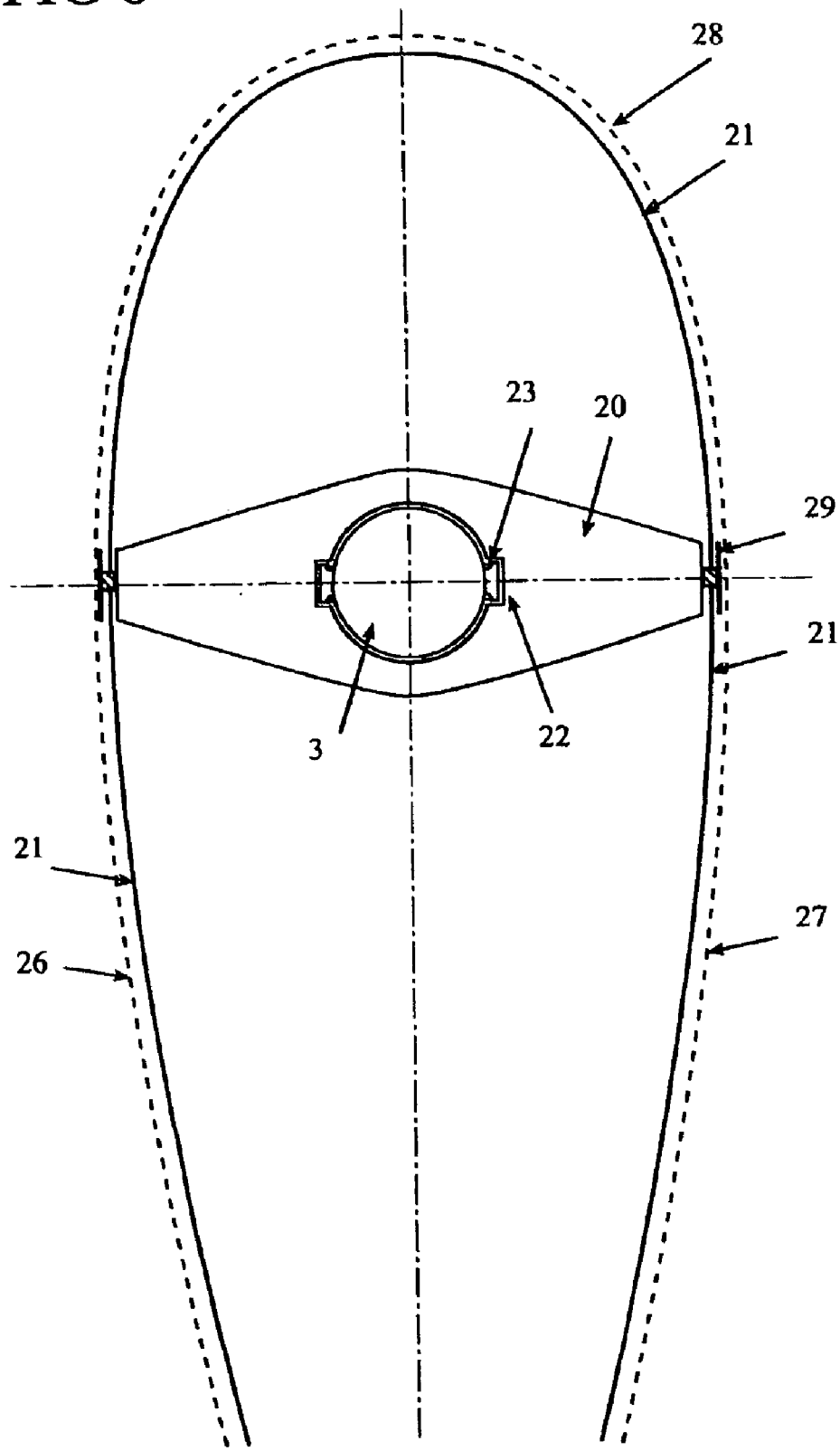
FIG. 8 is a top view illustrating another construction of slidable spreader unit that may be used in the flexible wing-sail.

FIG. 8 illustrates a flexible wing-sail of a similar construction as described above, except that the spreader unit, therein designated 20', is of a slightly different configuration than spreader unit 20 shown in FIGS. 4 and 5. Each spreader unit 20' in FIG. 8 is also of a one part construction, being slidably mounted at its center on the mast 3'; it also, extends transversely of the leading edge of the flexible wing-sail 4', joining the leading edges of the two flexible panels 26', 27', to the rounded panel 28' at the leading edge of the flexible wing-sail.

Figure 9:
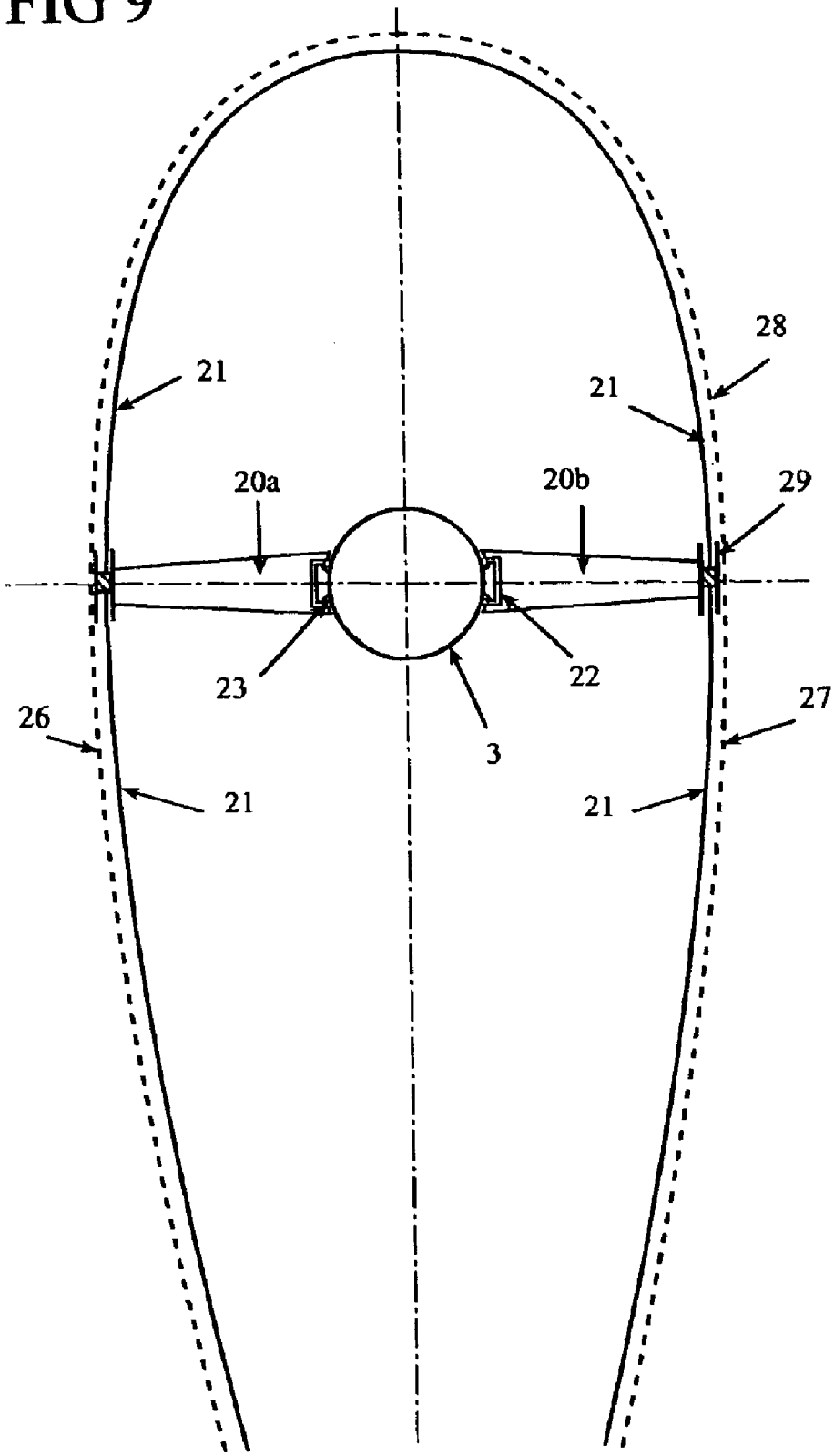
FIG. 9 is a view similar to that of FIG. 8, but illustrating a still further construction of slidable spreader unit that may be used.

FIG. 9 illustrates a slightly different construction wherein each of the spreader units is made of two sections, shown at 20*a*", 20*b*", respectively. One end of each section joins the rounded sail panel 28" at the leading edge of the flexible wing-sail to the respective sail panels 26", 27". The opposite end of each section is slidably mounted to the mast 3". In all other respects, the flexible wing-sail illustrated in FIG. 9 is constructed and is used in the same manner as described above.

Figure 10A:
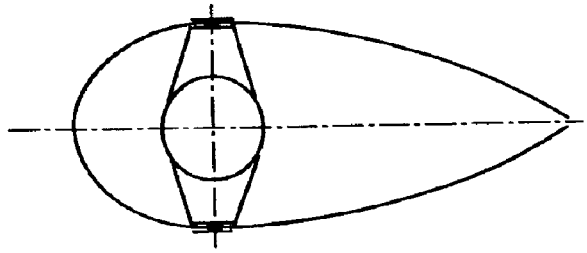
FIG. 10*a* is a top view illustrating a modification in the construction of the top spreader unit that may be used.
Figure 10B:
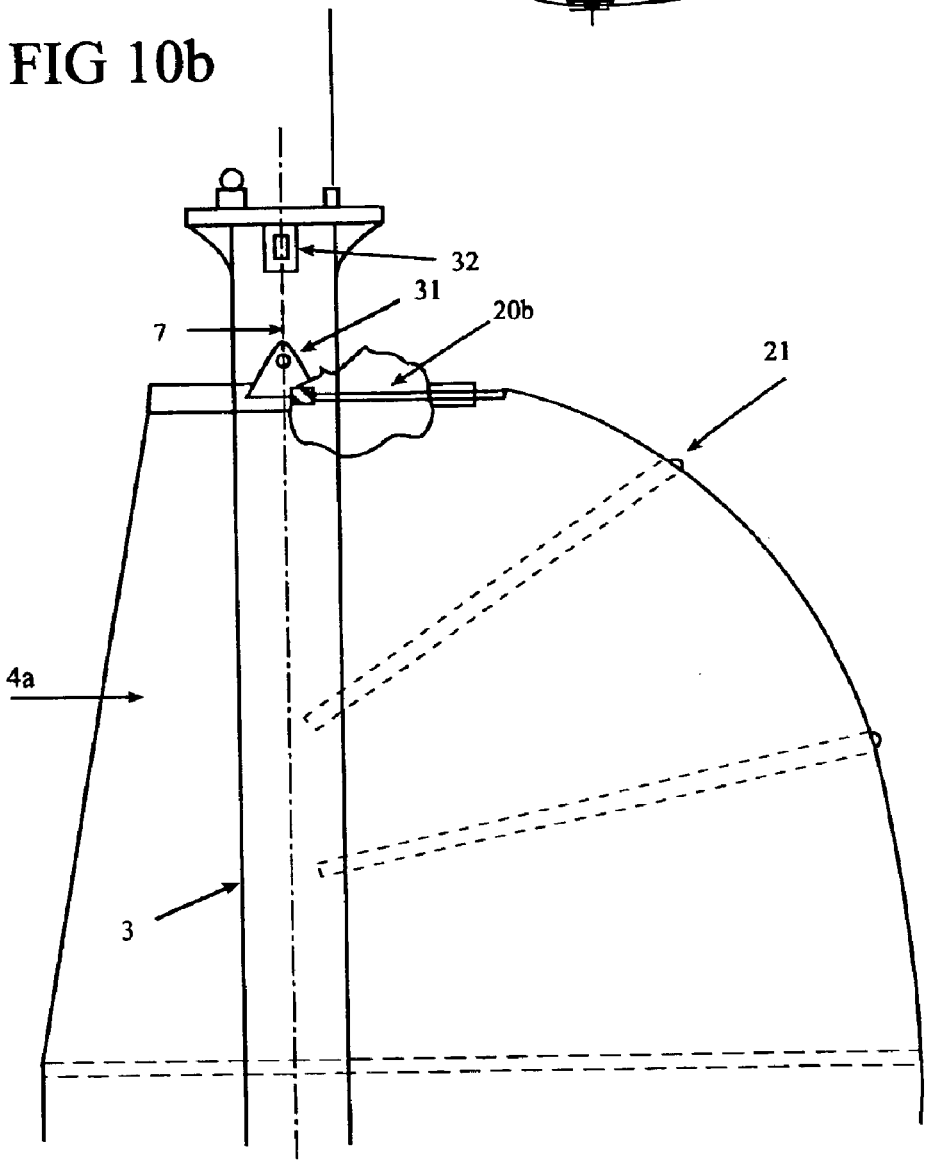
FIG. 10*b* is a fragmentary view illustrating the upper end of the flexible wing-sail when using the top spreader unit shown in FIG. 10*a;*

FIGS. 10*a* and 10*b* illustrate the option of mounting the halyards 7 directly to the upper end of the flexible wing-sail to fully hoist it, to fully reef it, or to partially reef it. Thus one end of each halyard 7 is coupled to a tab 41 secured to the top of the respective sail panel and passes around a roller 42 fixed to the top plate 33 at the upper end of the mast 3, such that the halyard may be pulled to hoist the flexible wing-sail, or released to partially or fully reef it. As shown in FIG. 1, the trailing end of the flexible wing-sail may be provided with a plurality of tabs 41 along its height, to enable the flexible wing-sail to be secured in a partially reefed condition.

FIGS. 11*a*, 11*b* illustrate the manner in which the flexible wing-sail 4 may be formed into a desired asymmetric airfoil shape according to the apparent wind direction. For this purpose the aft end of the boom 5 is provided with a boom line 40 which may be pulled towards the hull axis, in order to pivot the boom 5 with respect to the mast 3, when the flexible wing-sail direction is parallel to the wind and the mast is locked in place by the locking device 15 (FIG. 2). Thus, as shown in FIGS. 11*a* and 11*b*, when the mast is locked against rotation, pulling boom line 40 to pivot the boom 5 towards the hull axis will cause slides 31 and 32, at the trailing edges of the two sail panels 26, 27, to slide within their respective slots 31*a*, 32*a* of the boom, thereby enabling the curvature of the two sail panels 26, 27 to be increased; whereas releasing the boom line to permit the boom to pivot away from the hull axis by the wind force, will cause the slides 31, 32 to move in their respective slots, thereby decreasing the curvature of the sail panels up to a symmetrical airfoil configuration.

The battens 21 are preferably of varying thickness, being thicker at the front end of the sail panels 26, 27, than at the trailing end 4*b*. Each batten is attached at its front to the respective spreader unit 20, and at its rear to the respective sail panel 26, 27. Thus, when the wind is in the direction shown in FIG. 11*a* and 11*b* and the flexible wing-sail direction is parallel to the wind, pivoting the boom 5 towards the hull axis causes, in both cases, the sail panel on the leeward side to assume a convex form, and the sail panel on the windward side to assume a concave form. In this way, the airfoil shape of the flexible wing-sail assumes an asymmetric form in accordance with the wind direction, whether the wind is from the port or from the starboard side.

Figure 12A:
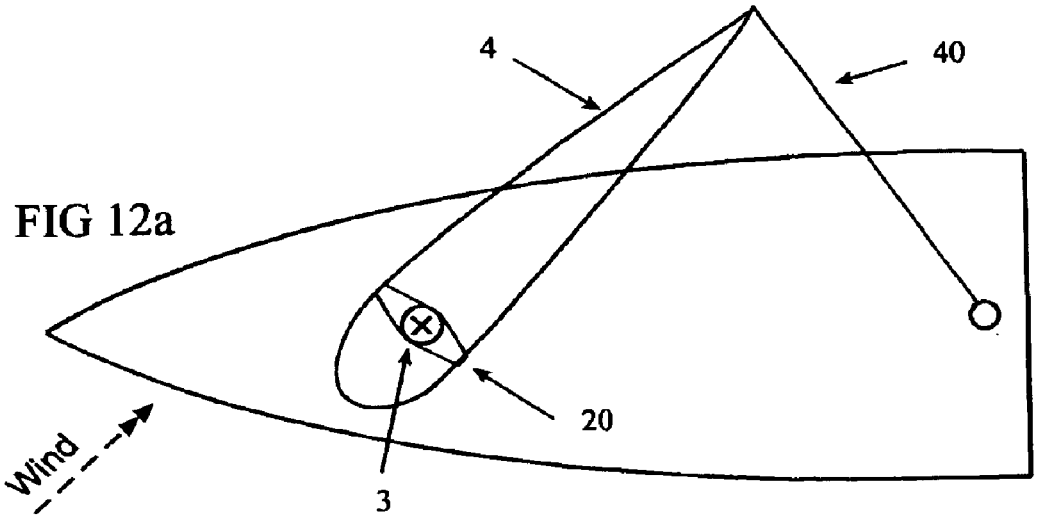
FIGS. 12*a,* 12*b* and 12*c* diagrammatically illustrate the manner in which the curvature of the airfoil may be changed according to the apparent wind direction and force.
Figure 12B:
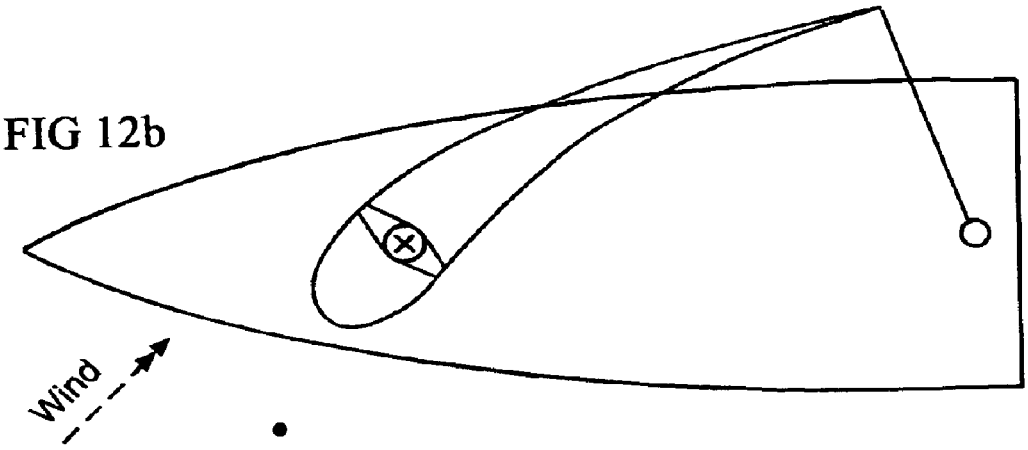
Figure 12C:
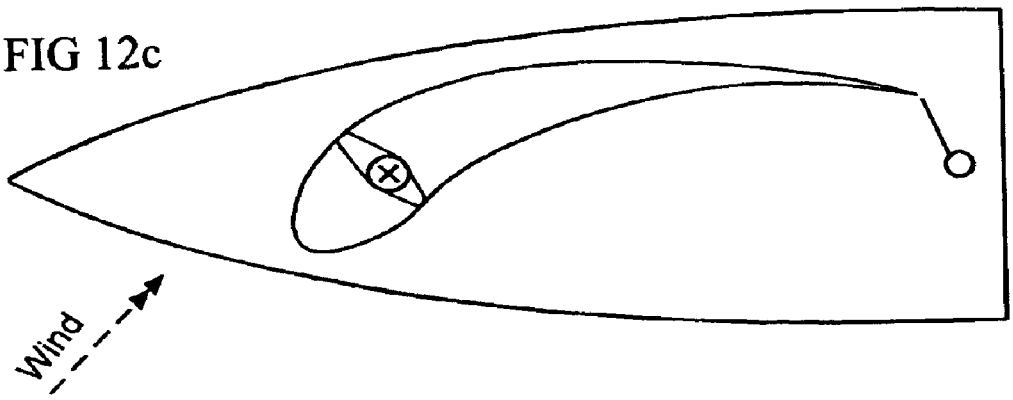

FIGS. 12*a*–12*c* illustrate the deployment of the flexible wing-sail 4 under varying wind conditions.

In FIG. 12*a*, the wind is of high velocity producing a high wind force applied to the flexible wing-sail. In this case, the mast lock 15 (FIG. 2) would be released so that the mast 3 would freely rotate to enable the flexible wing-sail to assume the direction of the wind, as shown in FIG. 12*a*. In this case, the axis of the boom 5 is perpendicular to the axis of the mast 3, so that the flexible wing-sail 4 assumes a symmetrical airfoil shape.

It will be appreciated that, in a high wind condition, the sail may be partially reefed or fully reefed in order to decrease the wind force applied to the flexible wing-sail, although actually, the drag of the airfoil produced by a hoisted wing-sail is less than the drag produced by the mast itself in a fully reefed wing-sail.

FIG. 12*b* illustrates the condition wherein there is a medium wind force. In this case, the mast 3, after assuming the wind direction, would be locked against rotation, and the boom line 40 would be pulled to pivot the boom 5 towards the hull axis. This will cause the airfoil to become asymmetric in shape and the angle of attack to increase, as described above with respect to FIGS. 11*a* and 11*b* and as shown in FIG. 12*b,* which thereby increases the aerodynamic forces applied by the wind to the flexible wing-sail.

FIG. 12*c* illustrates the condition wherein there is very low wind velocity. In this case, the boom 5 is pivoted to a greater extent towards the axis of the hull while the mast is locked against rotation. This increases the curvature of the airfoil as well as the angle of attack, and thereby increases the aerodynamic forces applied by the wind to the flexible wing-sail.

The flexible wing-sail as described above may be controlled as already described without recourse to any mechanically drives. When such a flexible wing-sail is to be implemented in a larger vessel, and/or when automation is desired, the system may include electric or hydraulic motors to control the various operations described above.

Figure 13:
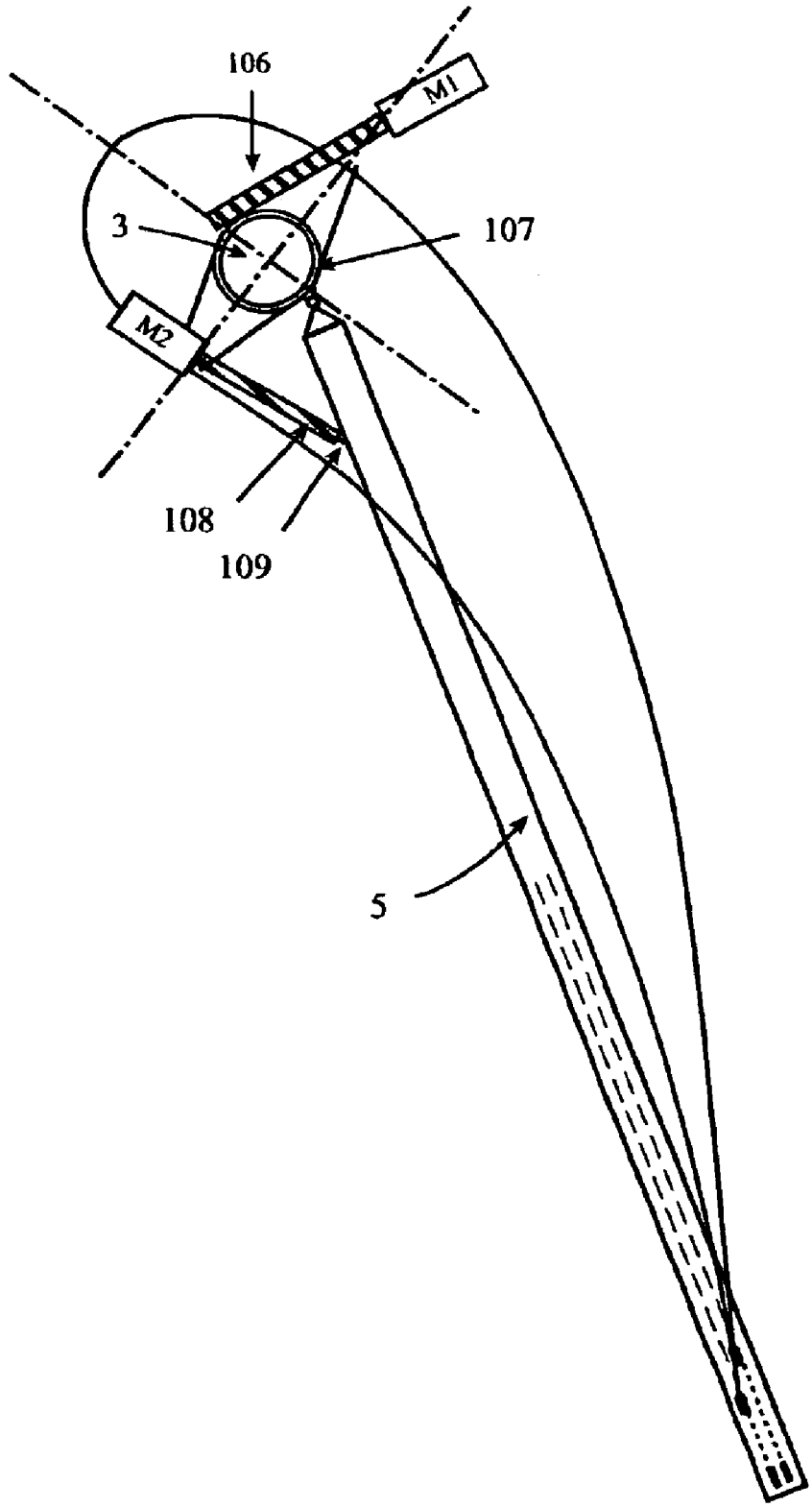
FIG. 13 diagrammatically illustrates a flexible wing-sail constructed in accordance with the present invention equipped with motor drives for manually or automatically controlling the orientation and/or curvature of the airfoil according to apparent wind conditions.
Figure 14:
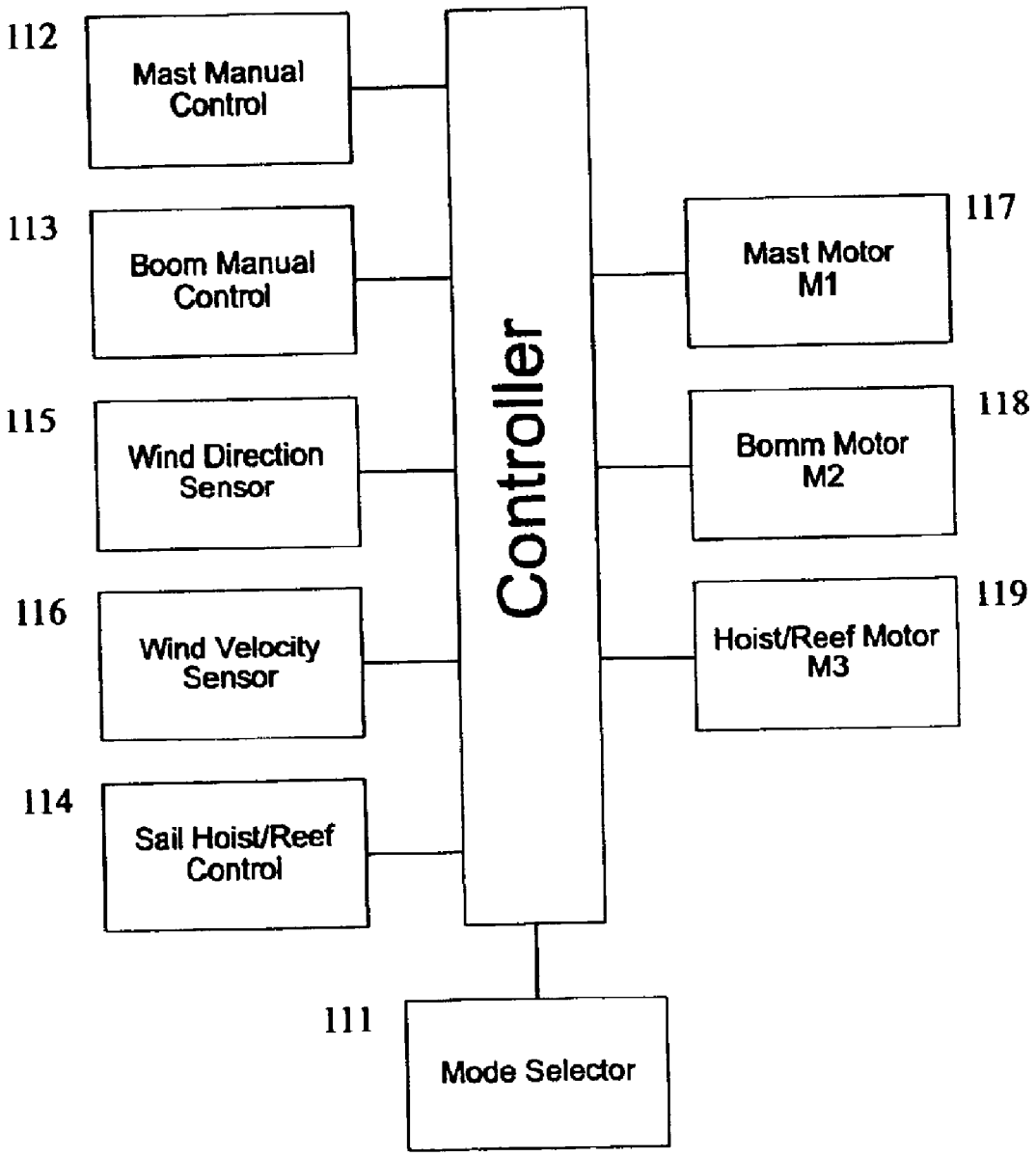
FIG. 14 is a block diagram illustrating a control system which may be used for controlling the flexible wing-sail of FIG. 13 according to the apparent wind conditions.

FIG. 13 diagrammatically illustrates a motorized control that may be used for the various control operations; and FIG. 14 diagrammatically illustrates a control system which may be used for either manual control or automatic control.

Thus, as shown in FIG. 13, the mast 3 carrying the flexible wing-sail 4 may be rotated by a motor $M_1$ via a gear 106 driven by the motor and meshing with a gear 107 fixed to the mast. As also shown in FIG. 13, the boom 5 may be pivoted towards or away from the hull axis by a second motor $M_2$ driving a nut 108 with respect to a screw 109 coupled to the boom.

The vehicle may also include a third motor $M_3$ (FIG. 14) coupled to the halyards (e.g., 7, FIG. 1) for raising and lowering the flexible wing-sail.

FIG. 14 illustrates a control system, generally designated 110, which may be operated according to either a manual mode or an automatic mode, as may be selected by a mode selector 111. When the manual mode is selected, the rotary position of the mast may be controlled by manual control device 112 which controls motor $M_1$ to rotate the mast; and the degree of curvature of the airfoil may be selected by manual control device 113 which controls motor $M_2$ to pivot the boom. The deployment of the flexible wing-sail may also be controlled by a manual control device 114 which controls motor $M_3$ to hoist or reef the flexible wing-sail.

On the other hand, when the automatic control is selected by the mode selector 111, motor $M_1$ which rotates the mast is automatically controlled by a wind direction sensor 115 to maintain the flexible wing-sail direction parallel to the apparent wind; and motor $M_2$ is automatically controlled in response to a wind velocity sensor 116 to change the angle of the boom with respect to the mast, and thereby the asymmetric curvature of the airfoil, in order to maintain the optimum airfoil shape in accordance with the apparent wind force.

It will thus be seen that when mode selector 111 of the controller 110 selects the automatic mode, the flexible wing-sail automatically turns into the right direction relative to the apparent wind, and at the same time, the airfoil shape is automatically adjusted to the right direction and the right degree of curvature so as to produce optimum aerodynamic efficiency.

A wind-driven vehicle constructed in accordance with the foregoing features of the invention thus provides the skipper with full control on everything required from a wing-sail. The effective surface area of the flexible wing-sail may be controlled by means of the halyards 7 to permit reefing as in a conventional sail; the direction of the flexible wing-sail may be controlled by releasing the mast brake device 15, letting the flexible wing-sail to spontaneously rotate and assume direction with respect to the apparent wind, and relock the mast brake device 15. In order to adjust the flexible wing-sail to the apparent wind force, the degree of asymmetry of the airfoil shape may be controlled by changing the angle between the boom 5 and the mast 3. The vehicle may include simple controls as described above, or the controls may be automated by a control system as also described above.

While the invention has been described above with respect to wind-driven water vehicles, it will be appreciated that the invention could also be implemented in wind-driven land vehicles or ice vehicles. Many other variations, modifications and applications of the invention will be apparent.

What is claimed is:

1. A flexible wing-sail for wind-propelled vehicles, comprising:

a mast to be rotatably mounted in a vertical position on the vehicle enabling the flexible wing-sail to freely rotate and assume parallel direction to the apparent wind;

a plurality of flexible sail panels carried by said mast and including first, second and third sail panels defining the opposite sides and the trailing edge of the flexible wing-sail, and a third sail panel defining the leading edge of the flexible wing-sail;

a spreader assembly securing said sail panels to the mast and imparting to the sail panels an airfoil shape having a leading edge fore of the mast, and a trailing edge aft of the mast;

a boom pivotally coupled above deck to the bottom of said mast and including a slidable coupling to the trailing edge of each of said first and second sail panels;

and a brake for selectively locking the mast against rotation with respect to the vehicle, such that pivoting the boom while the mast is locked against rotation, changes the curvature of the airfoil shape defined by the first and second sail panels according to the apparent wind direction and velocity.

2. The flexible wing-sail according to claim 1, wherein the trailing edge of each of said first and second sail panels is slidably coupled to said boom by a slide normally urged by an elastic element rearwardly of the boom away from the pivotal coupling of the boom to the mast.

3. The flexible wing-sail according to claim 1, wherein said spreader assembly includes a fixed spreader unit secured to the flexible sail panels defining the bottom of the flexible wing-sail and fixing it to the bottom of the mast, and a plurality of slidable spreader units secured to the flexible sail panels at longitudinally spaced locations thereof and slidable along said mast to permit hoisting and reefing the flexible wing-sail.

4. The flexible wing-sail according to claim 3, wherein said fixed spreader unit is secured only to the sail panels at the leading edge of the flexible wing-sail and fixes them above deck to the bottom of the mast, and said slidable spreader units are secured only to the sail panels at the leading edge of the flexible wing-sail and slidable mount them to the mast.

5. The flexible wing-sail according to claim 1, wherein said first, second and third sail panels include battens received in pockets in the respective sail panel, and wherein said spreader units are secured to said battens at the joined edges of the sail panels.

6. A flexible wing-sail for wind-propelled vehicles, comprising:

a mast to be rotatably mounted in a vertical position on the vehicle;

a plurality of continuous flexible sail panels carried by said mast;

and a spreader assembly securing said flexible sail panels to the mast and imparting to the flexible sail panels an airfoil shape having a leading edge fore of the mast, and a trailing edge aft of the mast;

said spreader assembly including a fixed spreader unit secured to the flexible sail panels defining the bottom of the flexible wing-sail and fixing it to the bottom of the mast, and a plurality of slidable spreader units secured to the flexible sail panels at longitudinally spaced locations thereof and slidable along said mast to permit hoisting and reefing the flexible wing-sail by unfolding and folding the wing-sail;

each of said spreader units being configured, dimensioned and secured to the flexible sail panels such as to permit flexibility between the leading and trailing edges of the portion of the wing sail occupied by the respective spreader unit.

7. The flexible wing-sail according to claim 6, wherein said fixed spreader unit is secured only to the sail panels at the leading edge of the flexible wing-sail and fixes them to the bottom of the mast, and said slidable spreader units are secured only to the sail panels at the leading edge of the flexible wing-sail and slidable mount them to the mast.

8. The flexible wing-sail according to claim 7, wherein said plurality of sail panels include first and second sail panels defining the opposite sides and the trailing edge of the flexible wing-sail, and a third sail panel defining the leading edge of the flexible wing-sail.

9. The flexible wing-sail according to claim 8, wherein the flexible wing-sail further includes a boom pivotally coupled to the bottom of said mast, the trailing edge of each of said first and second sail panels being slidably coupled to said boom.

10. The flexible wing-sail according to claim 9, wherein the mast includes a brake for selectively locking the mast against rotation with respect to the vehicle, such that pivoting the boom while the mast is locked against rotation, changes the curvature of the airfoil shape defined by the first and second sail panels.

11. The flexible wing-sail according to claim 10, wherein the trailing edge of each of said first and second sail panels is slidably coupled to said boom by a slide normally urged rearwardly of the boom away from the pivotal coupling of the boom to the mast.

12. The flexible wing-sail according to claim 11, wherein said slide is movable within a slot in said boom and is urged by a spring or by an elastic line rearwardly of the boom away from the pivotal coupling of the boom to the mast.

13. The flexible wing-sail according to claim 8, wherein said first, second and third sail panels include battens received in pockets in the respective sail panel, and wherein said spreader units are secured to said battens at the joined edges of the sail panels.

14. The flexible wing-sail according to claim 13, wherein said battens in the pockets of the third sail panel are stiffer than those in the pockets of said first and second sail panels.

15. The flexible wing-sail according to claim 8, wherein each of said slidable spreader units is slidably mounted at its center to said mast, and is secured at one end to the edge of the first sail panel joined to the third sail panel, and at its opposite end to the edge of the second sail panel joined to the third sail panel.

16. The flexible wing-sail according to claim 8, wherein each of said slidable spreader units includes a first section slidably mounted at one end to said mast and at its opposite end to the edge of the first sail panel joined to the third sail panel, and a second section slidably mounted at one end to said mast and at the opposite end to the edge of the second sail panel joined to the third sail panel.

17. A wind-propelled vehicle including a flexible wing-sail according to claim 1 and further including:

an apparent wind direction and wind force sensor;

a motor for selectively rotating said mast;

and a control system having:

(a) a manual mode of operation, wherein said motor is manually controlled to change the direction of the flexible wing-sail with respect to the apparent wind direction, and (b) an automatic mode of operation, wherein said motor is automatically controlled in response to the apparent wind direction, as sensed by said wind direction sensor, to maintain the flexible wing-sail direction parallel to the apparent wind direction.

18. The wind-propelled vehicle according to claim 17, wherein said vehicle further includes a wind velocity sensor for sensing the apparent wind velocity, and a second motor for selectively pivoting the boom to different angles with respect to the mast;

and wherein, in said control system, the manual mode of operation also permits manual control of said second motor to change the angle of the boom with respect to said mast, and thereby to change the curvature of the airfoil shape; and said automatic mode of operation automatically controls said second motor to change the angle of the boom with respect to the mast, and thereby the curvature of the airfoil shape, in response to the apparent wind velocity as measured by said wind velocity sensor.

19. A flexible wing-sail for wind-propelled vehicles, comprising:

a mast to be rotatably mounted in a vertical position on the vehicle;

a plurality of flexible sail panels carried by said mast;

and a spreader assembly securing said flexible sail panels to the mast and imparting to the flexible sail panels an airfoil shape having a leading edge fore of the mast, and a trailing edge aft of the mast;

said flexible sail panels being secured to said spreader assembly by battens received in pockets in said flexible sail panels;

each of said spreader units being configured, dimensioned and secured to the flexible sail panels such as to permit flexibility between the leading and trailing edges of the portion of the wing sail occupied by the respective spreader unit.

20. The flexible wing-sail according to claim 19, wherein said spreader assembly includes a fixed spreader unit secured to the flexible sail panels defining the bottom of the flexible wing-sail and fixing it to the bottom of the mast, and a plurality of slidable spreader units secured to the flexible sail panels at longitudinally spaced locations thereof and slidable along said mast to permit hoisting and reefing the flexible wing-sail.

21. The flexible wing-sail according to claim 19, further comprising:

a boom pivotally coupled at one end to the bottom of said mast and slidably coupled at the opposite end to the trailing edge of said sail panels by slides normally urged rearwardly of the boom by elastic elements;

and a brake for selectively locking the mast against rotation with respect to the vehicle, such that pivoting the boom while the mast is locked against rotation, changes the curvature of the airfoil shape according to the apparent wind direction and velocity.

* * * * *